US010392039B2

(12) United States Patent
Asuka et al.

(10) Patent No.: US 10,392,039 B2
(45) Date of Patent: Aug. 27, 2019

(54) GROUND CONTROL DEVICE AND WIRELESS TRAIN CONTROL SYSTEM

(71) Applicant: MITSUBISHI ELECTRIC CORPORATION, Chiyoda-ku, Tokyo (JP)

(72) Inventors: Masashi Asuka, Tokyo (JP); Atsushi Takami, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 15/765,323

(22) PCT Filed: Oct. 15, 2015

(86) PCT No.: PCT/JP2015/079192
§ 371 (c)(1),
(2) Date: Apr. 2, 2018

(87) PCT Pub. No.: WO2017/064792
PCT Pub. Date: Apr. 20, 2017

(65) Prior Publication Data
US 2018/0304909 A1 Oct. 25, 2018

(51) Int. Cl.
*B61L 23/16* (2006.01)
*B61L 25/02* (2006.01)
(Continued)

(52) U.S. Cl.
CPC ..... *B61L 23/16* (2013.01); *B61L 15/0027* (2013.01); *B61L 23/34* (2013.01); *B61L 25/02* (2013.01);
(Continued)

(58) Field of Classification Search
CPC .. B61L 23/16; B61L 27/0061; B61L 27/0038; B61L 25/025; B61L 27/0077;
(Continued)

(56) References Cited

U.S. PATENT DOCUMENTS

2012/0166025 A1 6/2012 Tokumaru
2013/0334373 A1* 12/2013 Malone, Jr. ..... B61L 23/044 246/2 R
2015/0232110 A1* 8/2015 Ghaly ..... B61L 27/0055 246/62

FOREIGN PATENT DOCUMENTS

JP 2014-88098 * 5/2014
WO WO 2011/021544 A1 2/2011

OTHER PUBLICATIONS

International Search Report (PCT/ISA/210) dated Dec. 22, 2015, by the Japanese Patent Office as the International Searching Authority for International Application No. PCT/JP2015/079192.
(Continued)

*Primary Examiner* — Anne M Antonucci
(74) *Attorney, Agent, or Firm* — Buchanan Ingersoll & Rooney PC

(57) ABSTRACT

To provide a wireless train control system that can perform a stable operation. The wireless train control system controls a wireless-control compliant train following a wireless-control noncompliant train by a ground control device. A stop limit point of the wireless-control compliant train is set by a track circuit in which a tail end position of the wireless-control noncompliant train is present. By using a track-circuit state signal indicating that the track circuit is turned on or turned off and a time-element-added track-circuit state signal indicating turn-off at a timing delayed by a set time after the track-circuit state signal has indicated turn-off, when the track-circuit state signal indicates turn-off and the time-element-added track-circuit state signal indi-
(Continued)

cates turn-on, it is determined that turn-off indicated by the track-circuit state signal is caused by the wireless-control compliant train that is a train itself being present, and the stop limit point is not updated.

15 Claims, 6 Drawing Sheets

(51) Int. Cl.
*B61L 23/34* (2006.01)
*B61L 25/06* (2006.01)
*B61L 15/00* (2006.01)
*B61L 27/00* (2006.01)

(52) U.S. Cl.
CPC ..... *B61L 25/025* (2013.01); *B61L 25/06* (2013.01); *B61L 27/0038* (2013.01); *B61L 27/0061* (2013.01); *B61L 27/0077* (2013.01); *B61L 2027/005* (2013.01)

(58) Field of Classification Search
CPC ..... B61L 25/06; B61L 15/0027; B61L 23/34; B61L 25/02; B61L 2027/005
See application file for complete search history.

(56) References Cited

OTHER PUBLICATIONS

Written Opinion (PCT/ISA/237) dated Dec. 22, 2015, by the Japanese Patent Office as the International Searching Authority for International Application No. PCT/JP2015/079192.

* cited by examiner

GROUND CONTROL DEVICE AND WIRELESS TRAIN CONTROL SYSTEM

FIELD

The present invention relates to a ground control device and a wireless train control system in which wireless-control compliant trains and wireless-control noncompliant trains coexist.

BACKGROUND

In a ground control device and a wireless train control system referred to as "communication based train control (CBTC)", train operation is controlled by communication between a wireless-control compliant train and a ground control device. In such a ground control device and a wireless train control system, a point at which a margin distance is ensured with respect to a tail end position of a preceding train is set as a stop limit point of the wireless-control compliant train. However, if a wireless-control compliant train and a wireless-control noncompliant train coexist on the same track, the ground control device cannot acknowledge the tail end position of the preceding train, which is the wireless-control noncompliant train. Therefore, in a conventional wireless train control system, it has been difficult to operate the wireless-control compliant train and the wireless-control noncompliant train in a state where they coexist on the same track.

Patent Literature 1 as a conventional technique has an object of realizing a ground control device and a wireless train control system in which a wireless-control compliant train and a wireless-control noncompliant train coexist, and discloses a technique related to "an automatic train control device including a ground control device 10 that calculates a stop target position 22 of a train, and on-vehicle control devices 1*a* and 1*b* that receive the stop target position 22 transmitted from the ground control device 10 to calculate speed control patterns 31 and 32 and control the speed of the train, wherein on train lines, a radio-equipped train 6 that wirelessly transmits a train ID/train position 21 to the ground control device 10 and a wireless non-mounted train 7 coexist, and the ground control device 10 controls on-rail train information 15 acquired from respective track circuits, the train ID/train position 21, train IDs, and train types in association with each other, calculates stop track-circuit information 23, and calculates the stop target position 22 with respect to the wireless mounted trains 6".

CITATION LIST

Patent Literature

International Publication No. WO2011/021544

SUMMARY

Technical Problem

However, according to the conventional technique described above, transmission delay in the ground control device and the wireless train control system has not been taken into consideration. Therefore, there is a problem that the current position of a train is recognized erroneously, which may cause a trouble for a stable operation of the ground control device and the wireless train control system.

The present invention has been achieved in view of the above, and an object of the present invention is to provide a ground control device and a wireless train control system that can perform a stable operation.

Solution to Problem

To solve the above problem and achieve the object, a ground control device and a wireless train control system according to the present invention controls a wireless-control compliant train following a wireless-control noncompliant train by a ground control device. A stop limit point of the wireless-control compliant train is set by a track circuit in which a tail end position of the wireless-control noncompliant train is present. And by using a track-circuit state signal indicating that the track circuit is turned on or turned off and a time-element-added track-circuit state signal indicating turn-off at a timing delayed by a set time after the track-circuit state signal has indicated turn-off, when the track-circuit state signal indicates turn-off and the time-element-added track-circuit state signal indicates turn-on, it is determined that turn-off indicated by the track-circuit state signal is caused by the wireless-control compliant train that is a train itself being present, and the stop limit point is not updated.

Advantageous Effects of Invention

According to the present invention, there is an effect where it is possible to obtain a ground control device and a wireless train control system that can perform a stable operation.

DESCRIPTION OF EMBODIMENTS

A ground control device and a wireless train control system according to an embodiment of the present invention will be described in detail below with reference to the accompanying drawings. The present invention is not limited to the embodiment.

Embodiment

Figure 1:
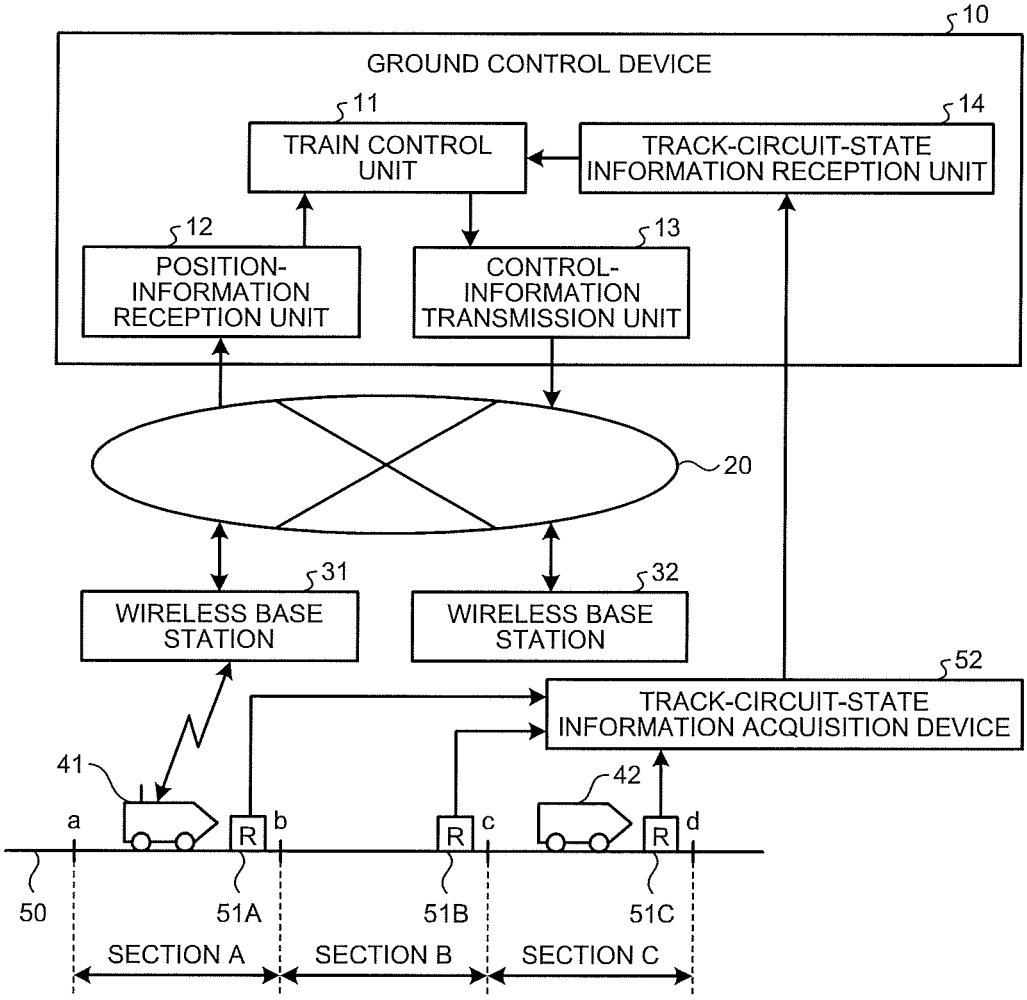
FIG. 1 is a diagram illustrating an example of a configuration of a ground control device and a wireless train control system according to an embodiment.

FIG. 1 is a diagram illustrating an example of a configuration of a ground control device and a wireless train control system according to an embodiment of the present invention. The ground control device and the wireless train control system illustrated in FIG. 1 includes a ground control device 10, a network 20, and wireless base stations 31 and 32, to control a wireless-control compliant train 41. The wireless-control compliant train 41 and a wireless-control noncompliant train 42 travel on a track 50. The wireless-control noncompliant train 42 is a preceding train of the wireless-control compliant train 41. The track 50 is divided into a section A between a point "a" and a point "b", a section B between the point "b" and a point "c", and a section C between the point "c" and a point "d". A relay 51A is disposed in the section A, a relay 51B is disposed in the section B, and a relay 51C is disposed in the section C. A track-circuit-state information acquisition device 52 acquires track-circuit state information indicating whether the relays 51A, 51B, and 51C are turned on or off, and transmits the acquired track-circuit state information to the ground control device 10. In FIG. 1, the wireless-control compliant train 41 is in the section A, and the wireless-control noncompliant train 42 is in the section C. The wireless-control compliant train 41 is a train whose operation is controlled by the ground control device 10 compliant the wireless train control system, and the wireless-control noncompliant train 42 is a train that does not support the wireless train control system. A track circuit is provided on each in the respective sections A, B, and C.

The ground control device 10 includes a train control unit 11, a position-information reception unit 12, a control-information transmission unit 13, and a track-circuit-state information reception unit 14. The position-information reception unit 12 receives position information of the wireless-control compliant train 41 from the wireless base stations 31 and 32 via the network 20 and outputs the pieces of position information to the train control unit 11. The position information of the wireless-control compliant train 41 is indicated by a block number obtained by dividing the track 50 and the position thereof in the block for each of a top position and a tail end position of the wireless-control compliant train 41. The track-circuit-state information reception unit 14 receives and outputs the track-circuit state information of the track 50 to the train control unit 11. The train control unit 11 generates control information of the wireless-control compliant train 41 by using the position information of the wireless-control compliant train 41 output from the position-information reception unit 12 and the track-circuit state information of the wireless-control compliant train 41 output from the track-circuit-state information reception unit 14 and outputs the control information to the control-information transmission unit 13. The control-information transmission unit 13 transmits the control information of the wireless-control compliant train 41 output from the train control unit 11 to the wireless-control compliant train 41 from the wireless base stations 31 and 32 via the network 20.

In this manner, the ground control device 10 can acquire the position information of the wireless-control compliant train 41 via the network 20 and the wireless base station 31, but cannot acquire the position information of the wireless-control noncompliant train 42 by wireless communication. Therefore, the ground control device 10 generates a stop limit point based on the wireless-control noncompliant train 42 by using the track circuit of the track 50, without depending on the wireless communication. That is, the track circuit of the section C is turned off because the wireless-control noncompliant train 42 is on the rail therein. Therefore, the ground control device 10 generates or updates the stop limit point designating the point c as a base point, which is a boundary of the section C on the side of the wireless-control compliant train 41. The stop limit point is indicated by the block number obtained by dividing the track 50 and a distance from the boundary in the block indicated by the block number.

Figure 2:
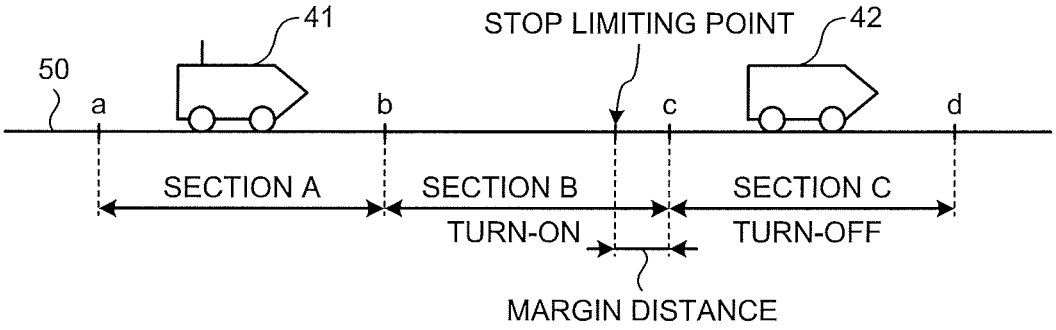
FIG. 2 is a diagram illustrating a stop limit point of a wireless-control compliant train in the wireless train control system according to the present embodiment.

FIG. 2 is a diagram illustrating a stop limit point of the wireless-control compliant train 41 in the ground control device and the wireless train control system according to the embodiment. The track circuit of the section C is turned off due to the presence of the wireless-control non-compliant train 42, and the track circuit of the section B is turned on. The ground control device 10 acknowledges that the wireless-control noncompliant train 42 is on the rail in the section C by using the track circuit of the track 50 and the position information by the wireless communication. The stop limit point of the wireless-control compliant train 41 is set at a position ensuring a margin distance from the point c, which is a boundary of the section B being turned on and the section C being turned off. That is, the stop limit point of the wireless-control compliant train 41 is present in the section B, and the wireless-control compliant train 41 can travel up to the stop limit point in the section B.

However, a transmission delay occurs in the ground control device and the wireless train control system illustrated in FIG. 1. Specifically, a transmission delay occurs in any of the transmission between the ground control device 10 and the network 20, between the network 20 and the wireless base stations 31 and 32, and between the wireless base stations 31 and 32 and the wireless-control compliant train 41. If such a transmission delay occurs, a deviation occurs between the on-rail position of the wireless-control compliant train 41 recognized by the ground control device 10 and the actual on-rail position of the wireless-control compliant train 41. The transmission delay time is decided based on the specification of the ground control device and the wireless train control system and is estimated to be about 3 seconds.

Figure 3:
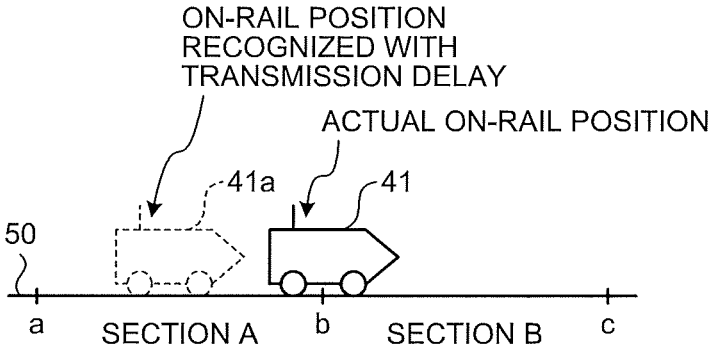
FIG. 3 is a diagram illustrating an actual on-rail position and a recognized on-rail position of the wireless-control compliant train in the present embodiment.

FIG. 3 is a diagram illustrating an actual on-rail position and a recognized on-rail position of the wireless-control compliant train 41 in the present embodiment. The wireless-control compliant train 41 in FIG. 3 just enters the section B over the point b. However, due to the transmission delay of the ground control device and the wireless train control system, the ground control device 10 recognizes that the position of the wireless-control compliant train 41 is at a position of a wireless-control compliant train 41*a* before entering the section B. The track circuit is turned off due to entrance of the wireless-control compliant train 41 into the section B. However, the ground control device 10 determines that the wireless-control noncompliant train is in the section B because there is no position information corresponding to the section B, and generates the stop limit point designating the point b as a base point so that the wireless-control compliant train 41*a* does not enter the section B where the track circuit has been turned off. Accordingly, a stop limit point, which is in front of the original point, is transmitted to the wireless-control compliant train 41, and because the actual on-rail position of the wireless-control compliant train 41 has passed the stop limit point, the wireless-control compliant train 41 is brought to an emergency stop.

In this manner, on the track 50 where the wireless-control compliant train 41 and the wireless-control noncompliant train 42 coexist, the position of the wireless-control noncompliant train 42 is acknowledged by the track circuit to decide the stop limit point of the wireless-control compliant train 41. However, if a transmission delay occurs in the ground control device and the wireless train control system, the ground control device 10 erroneously recognizes the position of the wireless-control compliant train 41, and the wireless-control compliant train 41 is brought to an emergency stop due to the track circuit turned off in the section B due to the train itself. That is, if a transmission delay occurs, there is a problem that the stop limit point is updated by the track circuit turned off by the train itself to cause an emergency stop.

Figure 4:
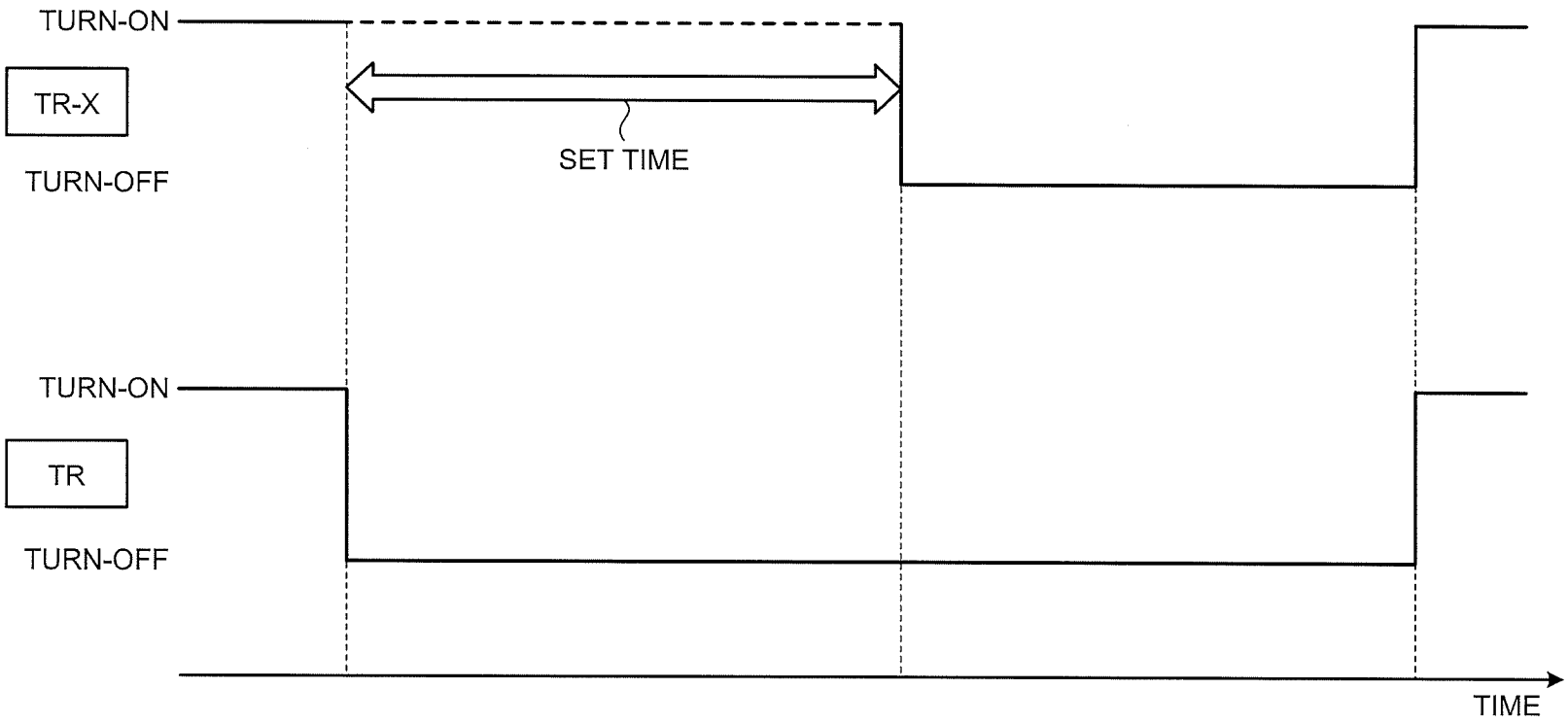
FIG. 4 is a diagram illustrating an example of a track-circuit state signal TR and a time-element-added track-circuit state signal TR-X in the embodiment.

Therefore, in the present embodiment, a track-circuit state signal TR being information indicating that the track circuit is turned on or off, and a time-element-added track-circuit state signal TR-X in which a time element is provided in the track circuit state are used. FIG. 4 is a diagram illustrating an example of the track-circuit state signal TR and the time-element-added track-circuit state signal TR-X in the embodiment. In FIG. 4, first, when the track-circuit state signal TR is turned off, counting of the time elements of the time-element-added track-circuit state signal TR-X is started. When the counting of the time elements of the time-element-added track-circuit state signal TR-X has reached a set time, the time-element-added track-circuit state signal TR-X is turned off. The set time is the maximum transmission delay time when the ground control device 10 acquires the position information of the wireless-control compliant train 41, which is decided depending on the specification of the ground control device and the wireless train control system. The timing to turn on the time-element-added track-circuit state signal TR-X may be the same as the timing at which the track-circuit state signal TR is turned on. The time-element-added track-circuit state signal TR-X is controlled by the ground control device 10. However, because the time-element-added track-circuit state signal TR-X is paired with the track-circuit state signal TR, such a configuration that the time-element-added track-circuit state signal TR-X is controlled by the track-circuit-state information acquisition device 52 and transmitted to the ground control device 10 may be adopted.

As illustrated in FIG. 4, when the time-element-added track-circuit state signal TR-X is introduced, while as illustrated in FIG. 3, the track-circuit state signal TR is turned off immediately after the wireless-control compliant train 41 enters the section B and until the set time, the time-element-added track-circuit state signal TR-X is turned on. In this manner, when a condition to refer to the time-element-added track-circuit state signal TR-X is established and the track-circuit state signal TR is turned off, and the time-element-added track-circuit state signal TR-X is turned on, it is determined that turn-off of the track-circuit state signal TR is caused by the train itself, and the stop limit point is not updated. According to the present embodiment, it can be prevented that the stop limit point is updated by the track circuit turned off by the train itself to bring the train to an emergency stop. Reference to the time-element-added track-circuit state signal TR-X may be made when the ground control device 10 generates the stop limit point with respect to the wireless-control compliant train 41, and the track-circuit state signal TR is turned off in front of the previous stop limit point. Further, it suffices that, by referring to a railway-track information database provided in the ground control device 10 and converting the sequence or the position information of the block in the route and the track circuit into kilometrage, it is determined whether the train is in front of the previous stop limit point according to the kilometrage.

Figure 5:
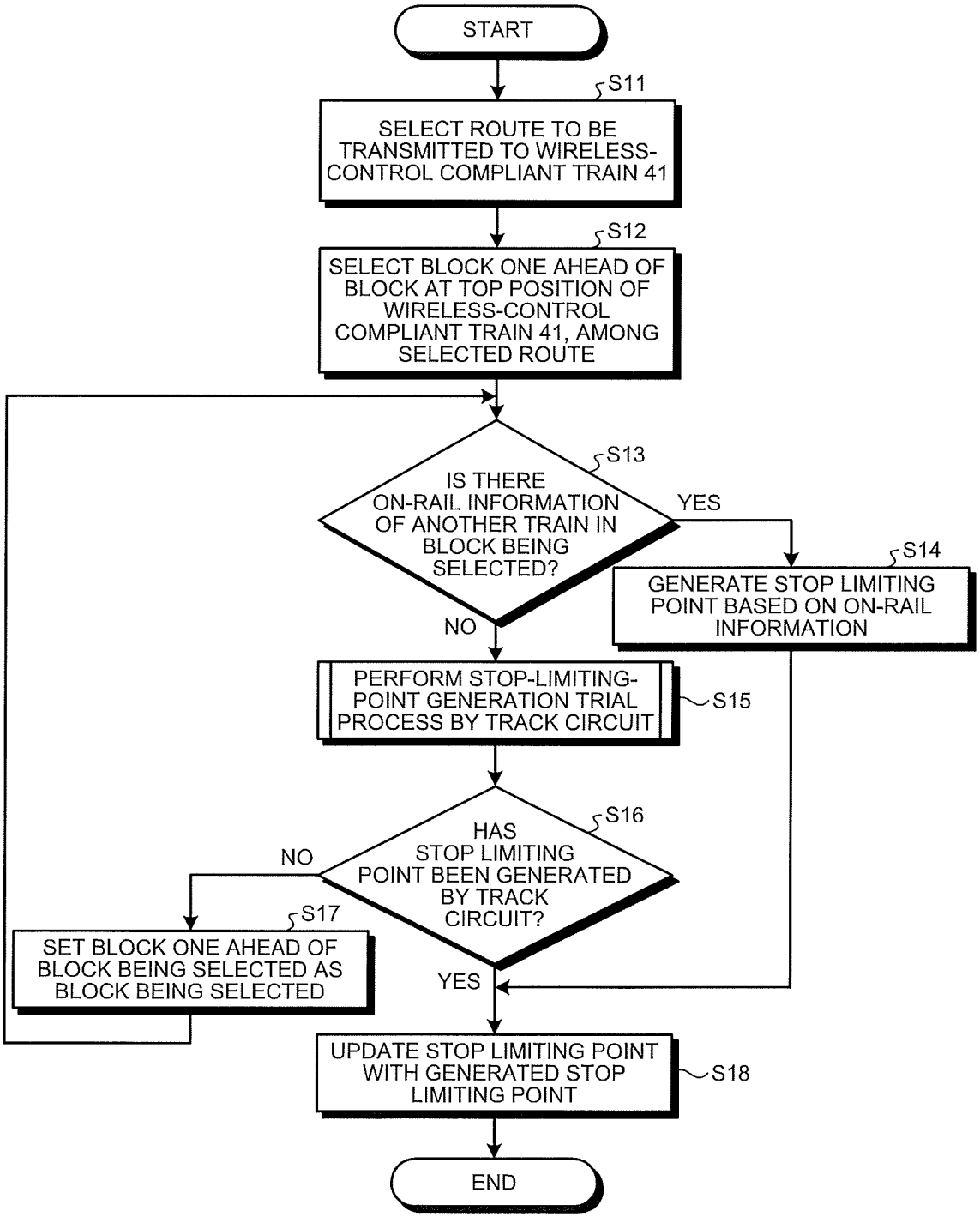
FIG. 5 is a flowchart illustrating an example of generation and update operations of a stop limit point to be performed by a train control unit of a ground control device in the wireless train control system according to the embodiment.

FIG. 5 is a flowchart illustrating an example of generation and update operations of the stop limit point to be performed by the train control unit 11 of the ground control device 10 in the ground control device and the wireless train control system according to the embodiment. The block described with reference to FIG. 5 is a section obtained by dividing the track finely, and the respective sections illustrated in FIG. 1 are constituted by a plurality of blocks. First, the train control unit 11 selects a route to be transmitted to the wireless-control compliant train 41 (S11). At this time, the stop limit point is set to a position designating a route end being the farthermost block end in a traveling direction as a base point. Next, the train control unit 11 selects a block one ahead of the block at the top position of the wireless-control compliant train 41, among the route selected at S11 (S12). That is, the train control unit 11 selects a block which the wireless-control compliant train 41 enters next. The block being selected that is selected here is described as a block being selected.

Next, the train control unit 11 determines whether there is on-rail information of another train in the block being selected (S13). The on-rail information here is information indicating whether another wireless-control compliant train is present in the ground control device and the wireless train control system. That is, at S13, it is determined whether another wireless-control compliant train is present in the block being selected. If there is on-rail information of another train including the block being selected (YES at S13), another wireless-control compliant train is present in the block. Therefore, the train control unit 11 generates a stop limit point according to the on-rail information (S14), updates the stop limit point by the generated stop limit point (S18), and the process is ended. If there is no on-rail information of another train including the block being selected (NO at S13), the train control unit 11 performs a stop-limit-point generation trial process by the track circuit (S15). Subprocesses at S15 are described later.

Next, the train control unit 11 determines whether the stop limit point has already been generated by the track circuit (S16). That is, the train control unit 11 determines whether a stop limit point has been generated by the track circuit by the process at S15. If the stop limit point has been generated by the track circuit (YES at S16), the train control unit 11 updates the stop limit point by the generated stop limit point (S18) and the process is ended. If the stop limit point has not been generated yet by the track circuit (NO at S16), the train control unit 11 selects a block one ahead of the block being selected as a block being selected and the process returns to S13 (S17). Thereafter, the processes after S13 are performed with respect to the block set as the block being selected at S17. If the stop limit point has not been generated by either the on-rail information or the track circuit and check of all the blocks in the selected route has finished, the position designating the route end set initially as a base point at S11 becomes the stop limit point.

Figure 6:
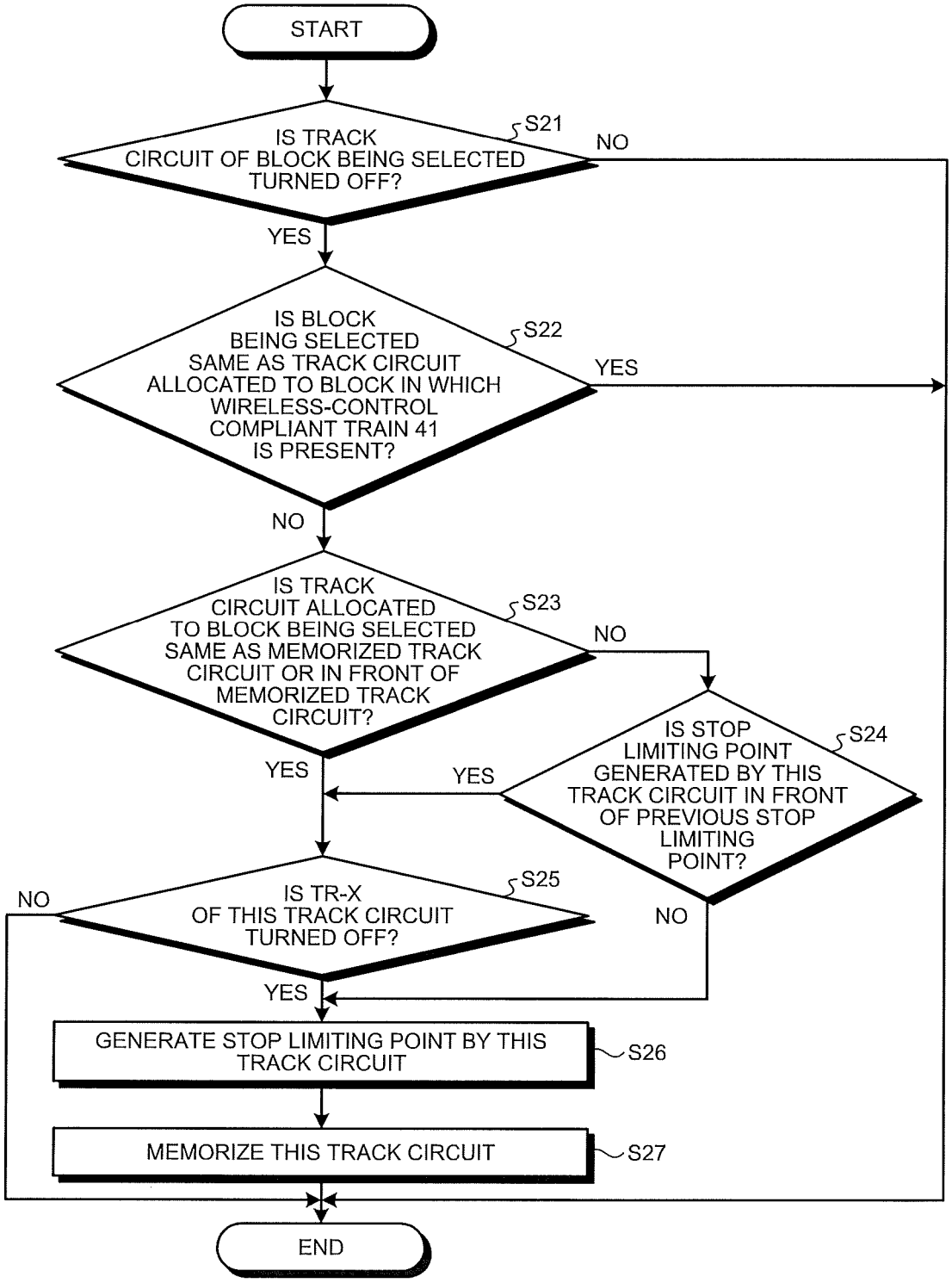
FIG. 6 is a flowchart illustrating an example of subprocesses to be performed at S15 in FIG. 5.

FIG. 6 is a flowchart illustrating an example of the subprocesses to be performed at S15 in FIG. 5. First, the train control unit 11 determines whether the track circuit in the block being selected is turned off (S21). If the track circuit in the block being selected is not turned off (NO at S21), that is, in the case of being turned on, there is no train in the block, and the process is ended without generating the stop limit point.

If the track circuit in the block being selected is turned off (YES at S21), the train control unit 11 determines whether the block being selected is a track circuit same as the track circuit allocated to a block in which the wireless-control compliant train 41 is present (S22). If the block being selected is a track circuit same as the track circuit allocated to the block in which the wireless-control compliant train 41 is present (YES at S22), the process is ended without generating the stop limit point. This is because, as described below, the block being selected is not appropriate as a block in which the stop limit point is to be generated.

Figure 7:
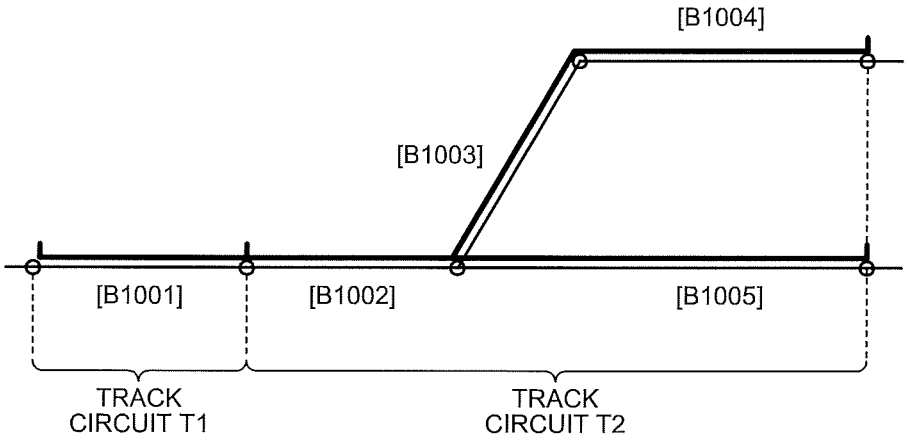
FIG. 7 is a diagram illustrating an example of a relation between a block number at a branch point and a track circuit in the embodiment.

FIG. 7 is a diagram illustrating an example of a relation between a block number at a branch point and a track circuit in the embodiment. In FIG. 7, a track divided into block numbers [B1001], [B1002], [B1003], [B1004], and [B1005] is illustrated, and a track circuit T1 is provided in the block number [B1001], and a track circuit T2 is provided in the block numbers [B1002], [B1003], [B1004], and [B1005]. The track illustrated in FIG. 7 branches to a route entering from [B1002] to [B1003] and a route entering from [B1002] to [B1005]. In this manner, one track circuit may be allocated over a plurality of blocks. Only one train can be present in the track circuit including the branch. Therefore, in this case, a train is present in the section of the block number [B1002], and it is understood that, when the track circuit T2 is turned off, the train itself is present in the track circuit T2. Therefore, as described above, if the block being selected is a track circuit same as the track circuit allocated to the block in which the wireless-control compliant train 41 is present (YES at S22), the process is ended without generating the stop limit point. The correspondence relation between the block and the track circuit is stored in the route information database provided in the ground control device 10.

If the block being selected is a track circuit different from the track circuit allocated to the block in which the wireless-control compliant train 41 is present (NO at S22), the train control unit 11 determines whether the track circuit allocated to the block being selected is the same as the track circuit memorized as being used for generation of the stop limit point or is in front of the memorized track circuit (S23). If the track circuit allocated to the block being selected is the same as the track circuit memorized as being used for generation of the stop limit point or is in front of the memorized track circuit (YES at S23), the process proceeds to S25. If the track circuit allocated to the block being selected is different from the track circuit memorized as being used for generation of the stop limit point and is not in front of the memorized track circuit (NO at S23), the train control unit 11 temporarily generates a stop limit point, designating the track circuit end as a base point, and determines whether the stop limit point is in front of the previous stop limit point (S24). In the case where the wireless-control compliant train 41 initially generates a stop limit point, there is no track circuit memorized as being used for generation of the stop limit point. Therefore, in this case, the train control unit 11 determines that the track circuit allocated to the block being selected is different from the track circuit memorized as being used for generation of the stop limit point and the process proceeds to S24 (NO at S23). Further, when there is no preceding train, there is no track circuit memorized as being used for generation of the stop limit point. Therefore, in this case, the train control unit 11 determines that the track circuit allocated to the block being selected is different from the track circuit memorized as being used for generation of the stop limit point (NO at S23).

If the stop limit point temporarily generated by designating the track circuit end as a base point is in front of the previous stop limit point (YES at S24), there is a possibility that the train itself causes turn-off of the track-circuit state signal TR. Therefore, the process proceeds to S25, and the train control unit 11 determines whether the time-element-added track-circuit state signal TR-X of the track circuit is turned off (S25). At S25, if the time-element-added track-circuit state signal TR-X is turned on, the train control unit 11 determines that the train itself causes the turn-off of the track-circuit state signal TR. If the time-element-added track-circuit state signal TR-X is turned off, the train control unit 11 determines that the turn-off of the track-circuit state signal TR is caused not by the train itself but by another train. If the time-element-added track-circuit state signal TR-X is not turned off (NO at S25), the train itself causes the turn-off of the track-circuit state signal TR, and thus the process is ended without updating the stop limit point. If the time-element-added track-circuit state signal TR-X is turned off (YES at S25), the train control unit 11 generates a stop limit point by the track circuit (S26), and memorizes that the track circuit is used for generation of the stop limit point, that is, updates the memory of generation of the stop limit point by the track circuit (S27), and the process is ended. At S24, if the stop limit point temporarily generated by designating the track circuit end allocated to the block being selected as a base point is not in front of the previous stop limit point (NO at S24), the train control unit 11 generates a stop limit point by the track circuit (S26), that is, adopts the stop limit point temporarily generated at S24 as the stop limit point, and memorizes that this track circuit is used for generation of the stop limit point, that is, updates the memory of generation of the stop limit point by the track circuit (S27), and the process is ended. Also, when there is no previous stop limit point, the process branches to NO at S24, and the train control unit 11 generates a stop limit point by the track circuit (S26), and memorizes that this track circuit is used for generation of the stop limit point, that is, updates the memory of generation of the stop limit point by the track circuit (S27), and the process is ended.

As described above, according to the present embodiment, it can be prevented that the wireless-control compliant train generates a stop limit point that is not accurate by a track circuit that has been turned off by the train itself, to bring the wireless-control compliant train to an emergency stop by the stop limit point. Therefore, a ground control device and a wireless train control system that can perform a stable operation can be acquired. Further, by preventing an unintended emergency stop of the wireless-control compliant train from occurring, an occurrence of power consumption due to the emergency stop and recovery therefrom can be prevented, thereby leading to low power consumption.

Figure 8:
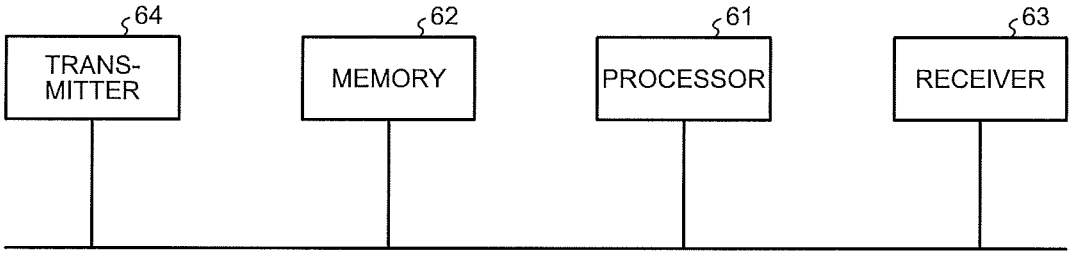
FIG. 8 is a diagram illustrating an example of a general configuration of hardware to realize the ground control device of the wireless train control system according to the embodiment.

In the present embodiment described above, the ground control device 10 includes at least a processor, a memory, a receiver, and a transmitter, and operations of the respective devices can be realized by software. FIG. 8 is a diagram illustrating an example of a general configuration of hardware to realize the ground control device 10 of the ground control device and the wireless train control system according to the present embodiment. The device illustrated in FIG. 8 includes a processor 61, a memory 62, a receiver 63, and a transmitter 64. The processor 61 uses received data to perform calculation and control by the software. The memory 62 memorizes received data, required data when the processor 61 performs the calculation and control, and the software. The receiver 63 corresponds to the position-information reception unit 12 and the track-circuit-state information reception unit 14, and is an interface to receive the position information and the track-circuit state information. The transmitter 64 corresponds to the control-information transmission unit 13, and is an interface to transmit the control information. The processor 61, the memory 62, the receiver 63, and the transmitter 64 may be respectively provided in plural.

In the above descriptions, it is assumed that the wireless-control noncompliant train 42 as a preceding train does not travel backward. If the ground control device 10 recognizes that the wireless-control noncompliant train 42 as a preceding train travels backward, the ground control device 10 immediately turns off the time-element-added track-circuit state signal TR-X. By monitoring the track-circuit state information, the ground control device 10 determines whether turn-off or turn-on of the track circuit is incorrect. As an example, when a traveling direction of the track 50 is set by the system, if a track circuit in an opposite direction to the permitted traveling direction is abruptly turned off, the ground control device 10 determines that the turn-off is incorrect. In this manner, backward travel of the wireless-control noncompliant train as a preceding train can be recognized by detecting incorrect turn-off in the track-circuit state information. Further, also when the ground control device 10 determines that the track circuit turned off due to a fault of the track circuit is incorrect turn-off, the ground control device 10 immediately turns off the time-element-added track-circuit state signal TR-X. Monitoring of the track-circuit state information and control of the time-element-added track-circuit state signal TR-X may be performed by the track-circuit-state information acquisition device 52.

In the present embodiment, at the time of startup of the ground control device 10, the time-element-added track-circuit state signal TR-X is turned off to prevent entrance of a train into a range in which there may be another train. When the track-circuit-state information acquisition device 52 controls the time-element-added track-circuit state signal TR-X, it suffices that the time-element-added track-circuit state signal TR-X is turned off at the time of startup of the track-circuit-state information acquisition device 52.

The configurations described in the above embodiment are only examples of the content of the present invention. The configurations can be combined with other well-known techniques, and a part of each configuration can be omitted or modified without departing from the scope of the present invention.

REFERENCE SIGNS LIST

10 ground control device, 11 train control unit, 12 position-information reception unit, 13 control-information transmission unit, 14 track-circuit-state information reception unit, 20 network, 31, 32 wireless base station, 41, 41*a* wireless-control compliant train, 42 wireless-control noncompliant train, 50 track, 51A, 51B, 51C relay, 52 track-circuit-state information acquisition device, 61 processor, 62 memory, 63 receiver, 64 transmitter.

The invention claimed is:

1. A ground control device installed on a ground, wherein the ground control device sets a stop limiting point of a wireless-control compliant train by a track circuit in which a tail end position of a wireless-control noncompliant train is present, and determines update of the stop limiting point of the wireless-control compliant train, based on a track-circuit state signal indicating that the track circuit is turned on or turned off and a time-element-added track-circuit state signal indicating turn-off after a set time has passed after the track-circuit state signal has indicated turn-off.

2. The ground control device according to claim 1, wherein the ground control device does not update the stop limiting point when the track-circuit state signal indicates turn-off and the time-element-added track-circuit state signal indicates turn-on.

3. The ground control device according to claim 1, wherein the ground control device updates the stop limiting point when the track-circuit state signal indicates turn-off and the time-element-added track-circuit state signal indicates turn-off.

4. The ground control device according to claim 1, wherein counting of the set time is started after turn-off of the track-circuit state signal.

5. The ground control device according to claim 1, wherein the set time is a transmission time when the ground control device acquires position information of the wireless-control compliant train.

6. The ground control device according to claim 1, wherein when having detected incorrect turn-off of the track circuit, the ground control device turns off the time-element-added track-circuit state signal.

7. A wireless train control system to control a wireless-control compliant train following a wireless-control noncompliant train by a ground control device, wherein a stop limiting point of the wireless-control compliant train is set by a track circuit in which a tail end position of the wireless-control noncompliant is present, and the wireless train control system determines update of the stop limiting point of the wireless-control compliant train, based on a track-circuit state signal indicating that the track circuit is turned on or turned off and a time-element-added track-circuit state signal indicating turn-off after a set time has passed after the track-circuit state signal has indicated turn-off.

8. The wireless train control system according to claim 7, wherein the wireless train control system does not update the stop limiting point when the track-circuit state signal indicates turn-off and the time-element-added track-circuit state signal indicates turn-on.

9. The wireless train control system according to claim 7, wherein the wireless train control system updates the stop limiting point when the track-circuit state signal indicates turn-off and the time-element-added track-circuit state signal indicates turn-off.

10. The wireless train control system according to claim 7, wherein counting of the set time is started after turn-off of the track-circuit state signal.

11. The ground control device according to claim 7, wherein the ground control device does not update the stop limiting point when the track-circuit state signal indicates turn-off and the time-element-added track-circuit state signal indicates turn-on.

12. The ground control device according to claim 7, wherein the ground control device updates the stop limiting point when the track-circuit state signal indicates turn-off and the time-element-added track-circuit state signal indicates turn-off.

13. A wireless train control system to control a wireless-control compliant train following a wireless-control non-compliant train by a ground control device, wherein a stop limit point of the wireless-control compliant train is set by a track circuit in which a tail end position of the wireless-control noncompliant train is present, and by using a track-circuit state signal indicating that the track circuit is turned on or turned off and a time-element-added track-circuit state signal indicating turn-off at a timing delayed by a set time after the track-circuit state signal has indicated turn-off, when the track-circuit state signal indicates turn-off and the time-element-added track-circuit state signal indicates turn-on, it is determined that turn-off indicated by the track-circuit state signal is caused by the wireless-control compliant train that is a train itself being present, and the stop limit point is not updated.

14. The wireless train control system according to claim 13, wherein the set time is a maximum transmission delay time when the ground control device acquires position information of the wireless-control compliant train.

15. The wireless train control system according to claim 13, wherein when having detected incorrect turn-off of the track circuit, the ground control device turns off the time-element-added track-circuit state signal.

* * * * *